US007758036B2

(12) United States Patent
Levine et al.

(10) Patent No.: US 7,758,036 B2
(45) Date of Patent: Jul. 20, 2010

(54) AUTOMATED COVER-DRIVEN WORKFLOWS FOR MANUFACTURING BOOKS IN A PRODUCTION ENVIRONMENT

(75) Inventors: Jonathan Levine, Rochester, NY (US); Michael Evan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/173,520

(22) Filed: Jul. 15, 2008

(65) Prior Publication Data

US 2008/0273945 A1 Nov. 6, 2008

Related U.S. Application Data

(62) Division of application No. 11/094,414, filed on Mar. 31, 2005, now Pat. No. 7,413,175.

(51) Int. Cl.
*B65H 37/04* (2006.01)

(52) U.S. Cl. ..... 270/58.08; 270/1.01; 270/12; 270/52.02; 270/58.07

(58) Field of Classification Search ..... 270/1.01, 270/12, 52.02, 58.07, 58.08; 399/407, 408, 399/409, 410

See application file for complete search history.

(56) References Cited

U.S. PATENT DOCUMENTS

| | | | | |
|---|---|---|---|---|
| 4,602,776 | A | 7/1986 | York et al. | |
| 4,800,506 | A | 1/1989 | Axelrod et al. | |
| 4,970,554 | A | 11/1990 | Rourke | |
| 4,987,447 | A | 1/1991 | Ojha | |
| 5,207,412 | A | 5/1993 | Coons, Jr. et al. | |
| 5,316,279 | A | 5/1994 | Corona et al. | |
| 5,465,213 | A | 11/1995 | Ross | |
| 6,193,458 | B1 | 2/2001 | Marsh | |
| 6,206,358 | B1 | 3/2001 | Yamaguchi et al. | |
| 6,213,456 | B1 | 4/2001 | Hirano et al. | |
| 6,412,721 | B2 | 7/2002 | Kawabe et al. | |
| 6,416,082 | B1 * | 7/2002 | Gayoso | 281/29 |
| 6,725,126 | B1 | 4/2004 | Doery | |
| 7,413,175 | B2 * | 8/2008 | Levine et al. | 270/58.08 |
| 2002/0031268 | A1 | 3/2002 | Prabhakar et al. | |
| 2003/0002068 | A1 | 1/2003 | Constantin et al. | |
| 2003/0063097 | A1 | 4/2003 | Prabhakar et al. | |
| 2005/0151981 | A1 * | 7/2005 | Levine et al. | 358/1.9 |
| 2006/0028662 | A1 | 2/2006 | Dobrovolsky | |

* cited by examiner

*Primary Examiner*—Gene Crawford
*Assistant Examiner*—Leslie A Nicholson, III
(74) *Attorney, Agent, or Firm*—MH2 Technology Law Group LLP

(57) ABSTRACT

A cover-driven book production method and system are disclosed. The method of cover-driven book production includes providing a plurality of book covers. The book covers can be identified using, for example, a scanner. A book block can then be retrieved from a book repository based on the identified cover. After performing raster image processing (RIP) of the book block, copies of the book block can be printed. Finishing can be accomplished by binding the printed book blocks to the book covers using an in-line binder or off-line binder.

7 Claims, 7 Drawing Sheets

AUTOMATED COVER-DRIVEN WORKFLOWS FOR MANUFACTURING BOOKS IN A PRODUCTION ENVIRONMENT

RELATED APPLICATION

The present application is a divisional of U.S. patent application Ser. No. 11/094,414, filed on Mar. 31, 2005, the disclosure of which is hereby incorporated by reference in its entirety.

FIELD OF THE INVENTION

The present invention generally relates to book production and, more particularly, relates to cover-driven digital book production.

BACKGROUND OF THE INVENTION

In a conventional digital book production workflow, electronic files for book blocks and covers are stored in a digital repository. To produce a book, the electronic files are retrieved and sent to a workstation or server, such as, for example, a digital front end (DFE) for data manipulation. The book block and cover files are subject to a raster image process (RIP) and then sent to an appropriate printer for printing of the book blocks and covers. The printed book blocks and covers are then finished by binding the covers to the book blocks.

Problems exist with conventional workflows because book blocks are often printed on different equipment than the covers. For example, mismatch problems occur when the wrong book block is associated with a cover. Miscount problems occur when the number of printed covers is different than the number of printed book blocks. Inefficiencies also exist because, to avoid the problems discussed, printing of a book block is often initiated after printing of the covers is completed.

Furthermore, recovery from these problems can be difficult. For example, if a printing system detects a book block/cover mismatch in a finishing system (such as, the Xerox DigiFinish™ system), the systems shuts down to avoid binding the book block to the wrong cover. As a result, paper fills the entire paper path of the printing system and the finishing system. Clearing the paper path can be time consuming.

Thus, there is a need to overcome these and other problems of the prior art and to provide a cover-driven system and method for book production.

SUMMARY OF THE INVENTION

In accordance with the present teachings, a method of book production is provided. The exemplary method can include providing a plurality of covers and examining a first cover of the plurality of covers to identify the first cover. A book block can then be retrieved based on the identified first cover. A raster image processing (RIP) of the book block can be performed before printing a copy of the book block. The first cover can then be bound to the copy of the book block.

In accordance with the present teachings, another method of book production is provided. The exemplary method can include instructing a first digital front end to retrieve an electronic file corresponding to a book cover from a book repository. The first digital front end and a second digital front end can then exchange information relating to the book cover electronic file to determine which book block to retrieve from the book repository. A book block file can then be retrieved from the book repository corresponding to the book cover. A plurality of copies of the book cover and a plurality of copies of the book block can be printed. A plurality of books can then be formed by binding the plurality of copies of the book block to the plurality of copies the cover.

In accordance with the present teachings, a book production system is provided. The exemplary book production system can include a book repository and a first digital front end (DFE) that drives a cover printer, wherein the first DFE receives cover information from the book repository. The exemplary system can further include a second DFE that drives a book block printer, wherein the second DFE receives book block information from the book repository. The book block printer can be configured to retrieve a corresponding book block from the book repository based on identification of a cover.

In accordance with the present teachings, another book production system is provided. The exemplary book production system can include a book repository and a first digital front end (DFE) that drives a cover printer, wherein the first DFE receives cover information from the book repository. The exemplary system further can include a second DFE that drives a book block printer, wherein the second DFE receives book block information from the book repository. The exemplary system can also include program code to control the first DFE and the second DFE, wherein the program code determines when a book block should be sent to the second DFE from the book repository based on a communication from the first DFE.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

FIGS. 1-4A depict exemplary methods and systems for cover-driven book production. The exemplary methods and systems include in-line binding in which the printed covers are automatically or semi-automatically transported to the binding equipment. The exemplary methods and systems also include off-line binding in which printed covers are manually transported to the binding equipment.

As used herein, the term "raster image processing" or "RIP" refers to a process of turning digital information into a high-resolution raster image. For example, the RIP can take digital information about fonts and graphics from a PostScript file that describe the appearance of the file and translate that information into an image composed of individual dots that an imaging device can output.

As used herein, a digital front end (DFE) is a workstation, server, or computer that can manipulate data, for example, RIPing a Postscript file, before it is sent to a printer.

Figure 1:
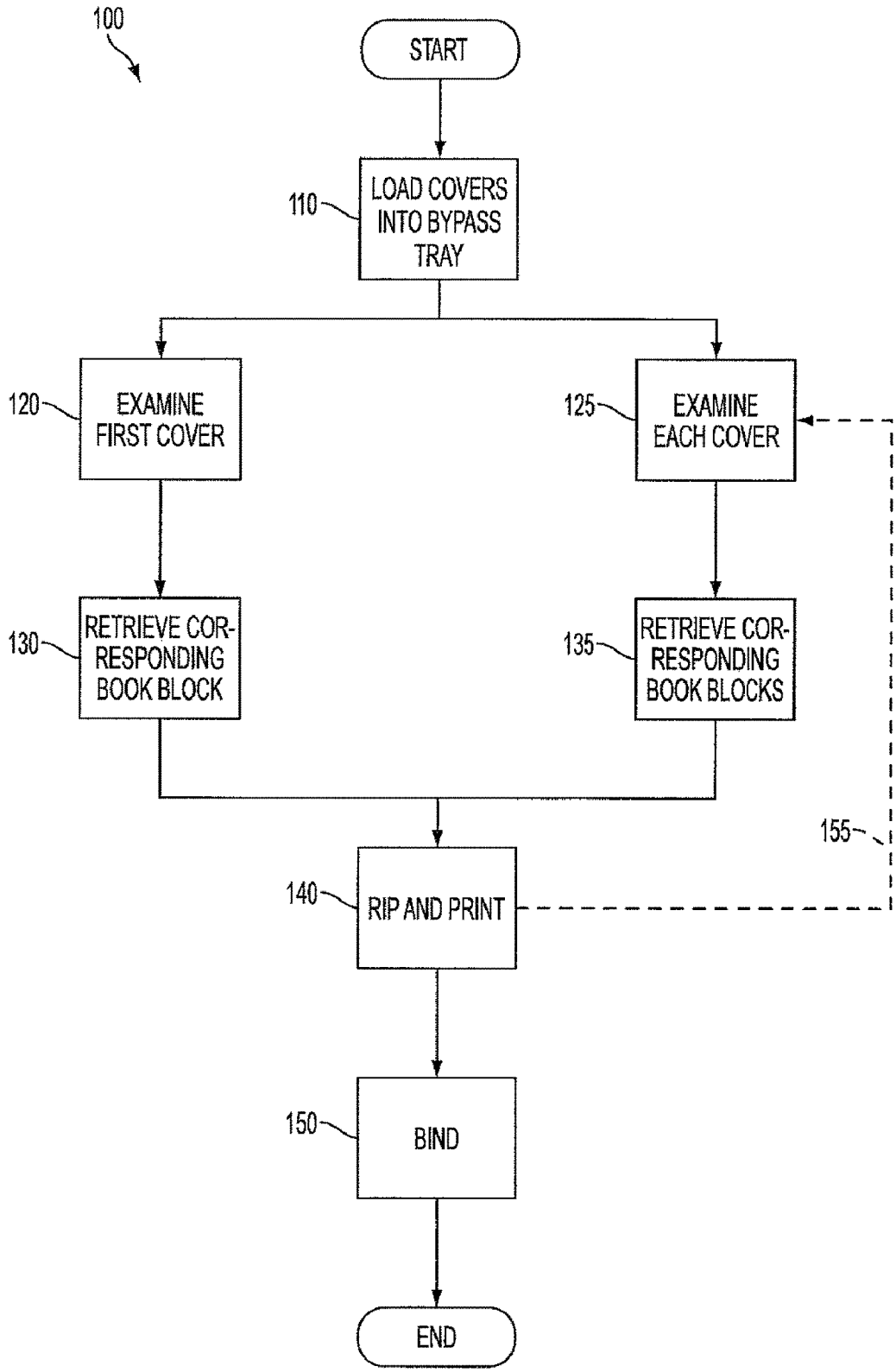
FIG. 1 depicts an exemplary method for cover-driven book production in accordance with embodiments of the present teachings.

Referring to FIG. 1, exemplary methods 100 for cover-driven book production with in-line binding are depicted. In 110, a plurality of printed covers can be loaded into a book block printer. For example, the printed covers can be loaded into a bypass tray or an interposer of the book block printer. According to various embodiments, each of the plurality of covers can be the same and, in 120, the first cover can be examined.

Examining the first cover in 120 can be accomplished by a scanner integrated into or positioned near the bypass tray. Alternatively, if no scanner is available in or near the bypass tray, a hand-held scanner can be used. After the first cover is examined and identified, a book block corresponding to the identified cover can be retrieved as shown in 130. Identifying the cover can, for example, utilize a bar code and/or a data glyph, extract semantic information from the first cover, and/or recognize unique characteristics of the first cover. The book block can be in the form of an electronic file stored in an electronic book repository.

The book block file can then be RIPed and printed as shown in 140. As each complete book block is printed, a cover can be fed from the bypass tray for binding to the book block as shown in 150. In the disclosed embodiment in which only the first cover of the plurality of covers is examined, no mismatch checking is performed. In various embodiments, a user can ensure that the first cover examined is the same as all of the covers loaded into the bypass tray.

Referring again to FIG. 1, another exemplary method 100 is provided in which mismatch checking is performed. As shown in 125, one cover of a plurality of covers can be examined and identified. As before, examining the cover in 125 can be accomplished by a scanner positioned in or near the bypass tray. Alternatively, if no scanner is available in or near the bypass tray, a hand-held scanner can be used. After the cover is examined and identified, a book block corresponding to the identified cover can be retrieved, for example from a book repository, as shown in 135.

The retrieved file corresponding to the identified book block can then be RIPed and printed in 140 and then sent for binding in 150. In various embodiments, as the retrieved file corresponding to the identified book block is RIPed and printed in 140 and, the identified cover can be fed for binding in 150. Alternatively, the identified cover can be fed for binding at any time after it is examined and identified. As the identified cover is being fed in 150, the next cover of the plurality of covers can be examined and identified. This is represented by dotted line 155. As the next cover is being examined and identified, binding of the first cover to the printed book block can be accomplished in 150. This cycle can continue until each of the plurality of covers has been examined. Because each cover of the plurality of covers can be examined before its corresponding book block is retrieved and printed, covers corresponding to more than one book block can be loaded into the bypass tray. For example, 10 covers from a first book, 15 covers from a second book, and 20 covers from a third book can be loaded into the bypass tray. The book block corresponding to the first book can be retrieved and printed after each of the 10 covers is identified. Subsequently, the book block corresponding to the second book can be retrieved and printed after each of the 15 covers is identified. And, the book block corresponding to the third book can be retrieved and printed after each of the 20 covers is identified. One of ordinary skill in the art understands that these numbers are exemplary and that the number of different covers can vary, and that the number of each cover can vary.

In various embodiments, examining the cover at 120 can initiate a program that controls printing of the book block. The program can be stored, for example on a printer, a DFE, workstation, or a server. The program can provide at least one of registration points, paper size, image size, and image location. The program can further control printing parameters, such as, for example, the number of books desired and/or specified on a job ticket.

Examining each cover can have additional benefits. For example, in various embodiments in which it is desirable to print a specified number of books, errors can occur if the number of covers loaded into the bypass tray does not correspond to the number of desired books. For example, the job ticket may specify x number of books to be printed, but more than x or less than x number of covers may have been loaded into the bypass tray. If such an error occurs, only the specified number of book block will be printed. Excess covers will not be fed, and the user will be notified of the error after the specified number of covers are bound to the correct number of book blocks.

In various embodiments, the book block printer can include a second bypass tray or interposer into which a second plurality of covers can be loaded. For example, while the book block corresponding to the first plurality of covers is being printed and bound, the second plurality of covers can be loaded into the second bypass tray. By identifying the covers and retrieving the book block corresponding to the second plurality of covers, the second book block can be ready for printing when as soon as the first book block is finished printing.

Referring again to FIG. 1, an exemplary cover-driven book production method using off-line binding is also provided. The exemplary off-line method can begin at 120 by examining, for example, a first cover of a plurality of covers using a hand-held scanner. Once the cover is examined and identified, retrieval of the corresponding book block can be initiated at 130.

As previously disclosed, examining and identifying the cover at 125 or 120 can initiate a program that controls printing of the book block. The program can be stored, for example on a printer, a DFE, workstation, or a server. The program can control printing parameters, such as, for example, the number of book blocks to be printed to correspond to the number of covers. After RIPing and printing at 140, the plurality of covers and the printed book blocks can be manually transported and loaded into binding equipment for binding.

Exemplary architectures for cover-driven printing systems that can implement the exemplary cover-driven methods disclosed above, as well as other exemplary methods disclosed herein, will now be discussed with reference to FIGS. 2A-3B.

Figure 2A:
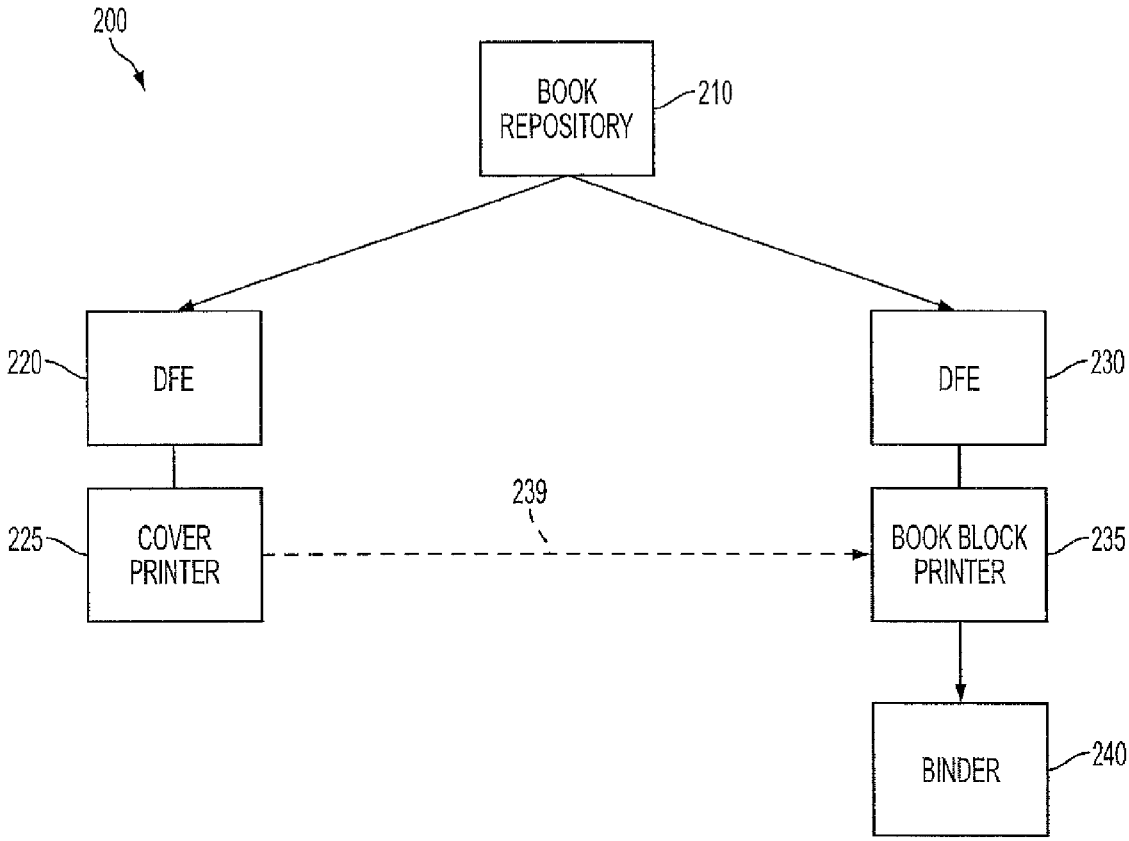
FIG. 2A depicts an exemplary architecture for a cover-driven book production system in accordance with embodiments of the present teachings.

Referring to FIG. 2A, an exemplary architecture for an in-line cover-driven system 200 is provided. System 200 can include a book repository 210, a first DFE 220, a cover printer 225, a second DFE 230, a book block printer 235, and an in-line binder 240. Book repository 210 can be, for example, a print-on-demand book repository containing a plurality of electronic files. The plurality of electronic files can include files for a plurality of covers, a plurality of book blocks, and, in various embodiments, a plurality of metadata. Metadata refers to data about data, such as, for example, information about an author (e.g., author bio, etc.), information about content of a book (e.g., the number of pages, chapter titles, etc.), and/or information on a transaction (e.g., royalty rates, digital rights, etc.).

Book repository 210 can reside on one or more computers, workstations, severs, DFE's and/or any storage medium for electronic files. An example is FreeFlow Document Library (formerly known as DigiPath™ Document Library).

Book repository 210 can send electronic files to the first DFE 220 and/or a second DFE 230. First DFE 220 can be, for example, configured to send data to cover printer 225. Second DFE 230 can be, for example, configured to send data to book block printer 235. In various embodiments, binder 240 can be disposed in-line with book block printer 235.

In operation, exemplary architecture for an in-line cover-driven system 200 can function as follows. Based on a job ticket or input by a user, first DFE 220 can retrieve a cover file from book repository 220. After manipulating the cover file, first DFE 220 can instruct cover printer 225 to print a number of copies of the cover. Copies of the covers can then be placed into the bypass tray of book block printer 235 for examination and identification. For example, copies of the cover can be manually transported by a user to the book block printer, as represented by dotted line 239. In an embodiment where each of the plurality of covers is the same, once the first cover is identified, second DFE 230 can retrieve the corresponding book block from book repository 210. Examination and identification of the cover can be accomplished with a scanner integrated into or near the bypass tray of book block printer 235 or by a hand-held scanner. After manipulating the book block file, second DFE 230 can provide data to book block printer 235 for printing a number of copies of the book block. The covers and book blocks can be sent to in-line binder 240 for binding.

Figure 2B:
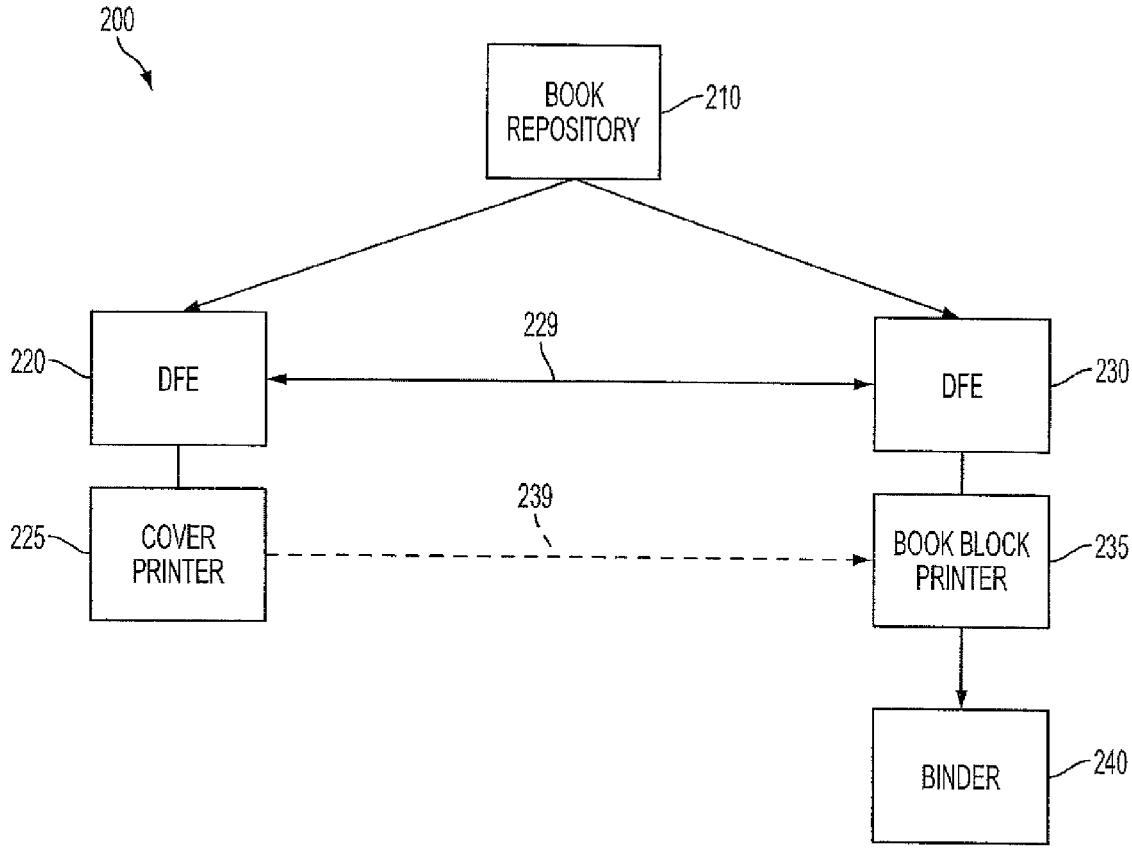
FIG. 2B depicts another exemplary architecture for a cover-driven book production system in accordance with embodiments of the present teachings.

In another embodiment shown in FIG. 2B, first DFE 220 and second DFE 230 can exchange information, represented by line 229, to determine, for example, which book block to retrieve from book repository 210 and the number of copies of the retrieved book block to be printed. In this embodiment, scanning need not be performed because identification of the book block corresponding to the cover can be determined by communication between first DFE 220 and second DFE 230. For example, based on a job ticket or input by a user, first DFE 220 can retrieve a cover file from book repository 220. After manipulating the cover file, first DFE 220 can provide data to cover printer 225 for printing a number of copies of the cover. At any time after retrieval of the cover file is initiated or at the same time retrieval of the cover file is initiated, second DFE 230 can communicate with first DFE 220 to determine which book block to retrieve from book repository 210. After retrieving the book block file corresponding to the cover file and manipulating the book block file, second DFE 230 can provide data to book block printer 235 for printing a number of copies of the book block. The covers and book blocks can be sent to in-line binder 240 for binding.

Figure 3A:
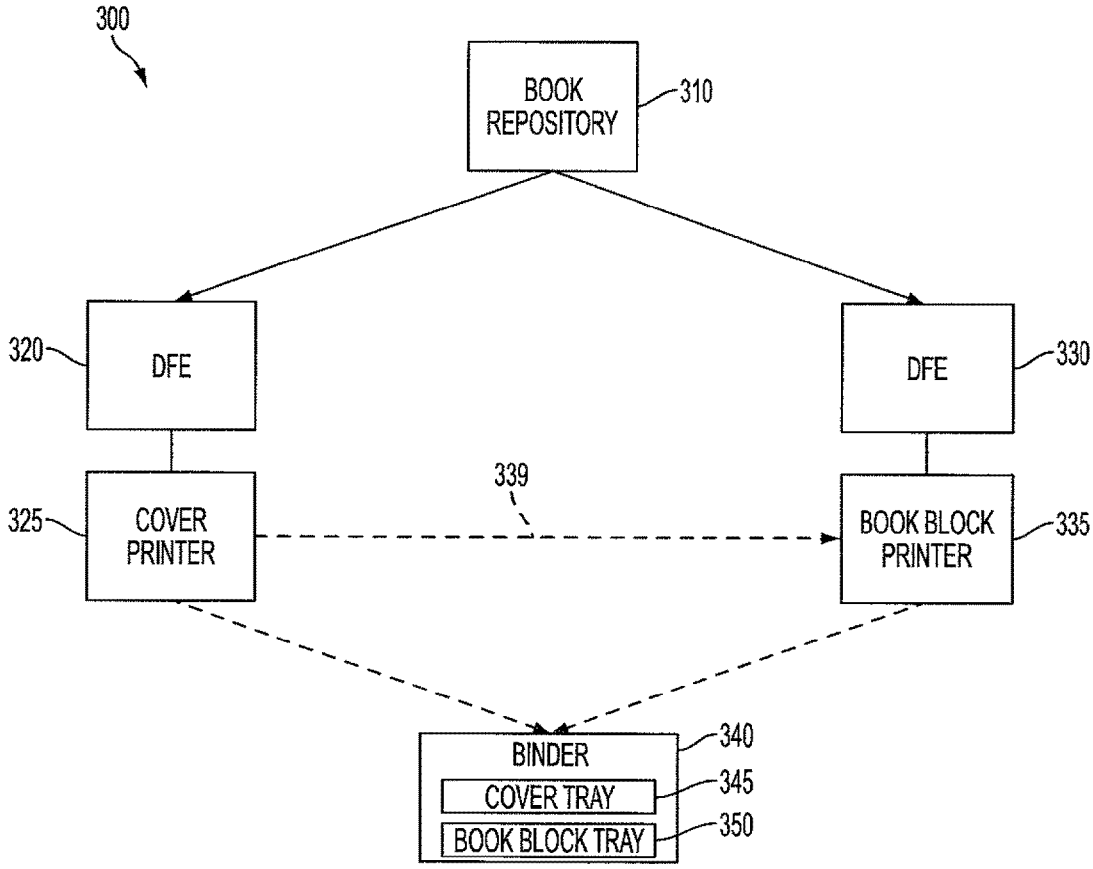
FIG. 3A depicts an exemplary architecture for a cover-driven book production system including a line of communications between two DFEs in accordance with embodiments of the present teachings.

Referring to FIG. 3A, another exemplary architecture for an off-line cover-driven system 300 is provided. System 300 can include a book repository 310, a first DFE 320, a cover printer 325, a second DFE 330, a book block printer 335, and an off-line binder 340. in operation, exemplary architecture for an off-line cover-driven system 300 can function as follows. Based on a job ticket or input by a user, first DFE 320 can retrieve a cover file from book repository 320. After manipulating the cover file, first DFE 320 can provide data to cover printer 325 for printing a number of copies of the cover. Copies of the covers can then be scanned by a hand-held scanner for examination and identification. In an embodiment where each of the plurality of covers is the same, once the first cover is examined by the hand-held scanner and identified, book block printer 335 can receive data relating to retrieval of the corresponding book block from book repository 310. Although FIG. 3A depicts the data relating to retrieval of the corresponding book block being directed to book block printer 335 by dotted line 339, one of ordinary skill in the art will understand that the data can also be directed to second DFE 330. After retrieving the corresponding book block file and manipulating the book block file, second DFE 330 can provide data to book block printer 335 for printing a number of copies of the book block. The covers and book blocks can then be manually transported to off-line binder 340 for binding. In embodiments, off-line binder 340 can comprise a tray 345 for loading book covers and a tray 350 for loading copies of book blocks.

Figure 3B:
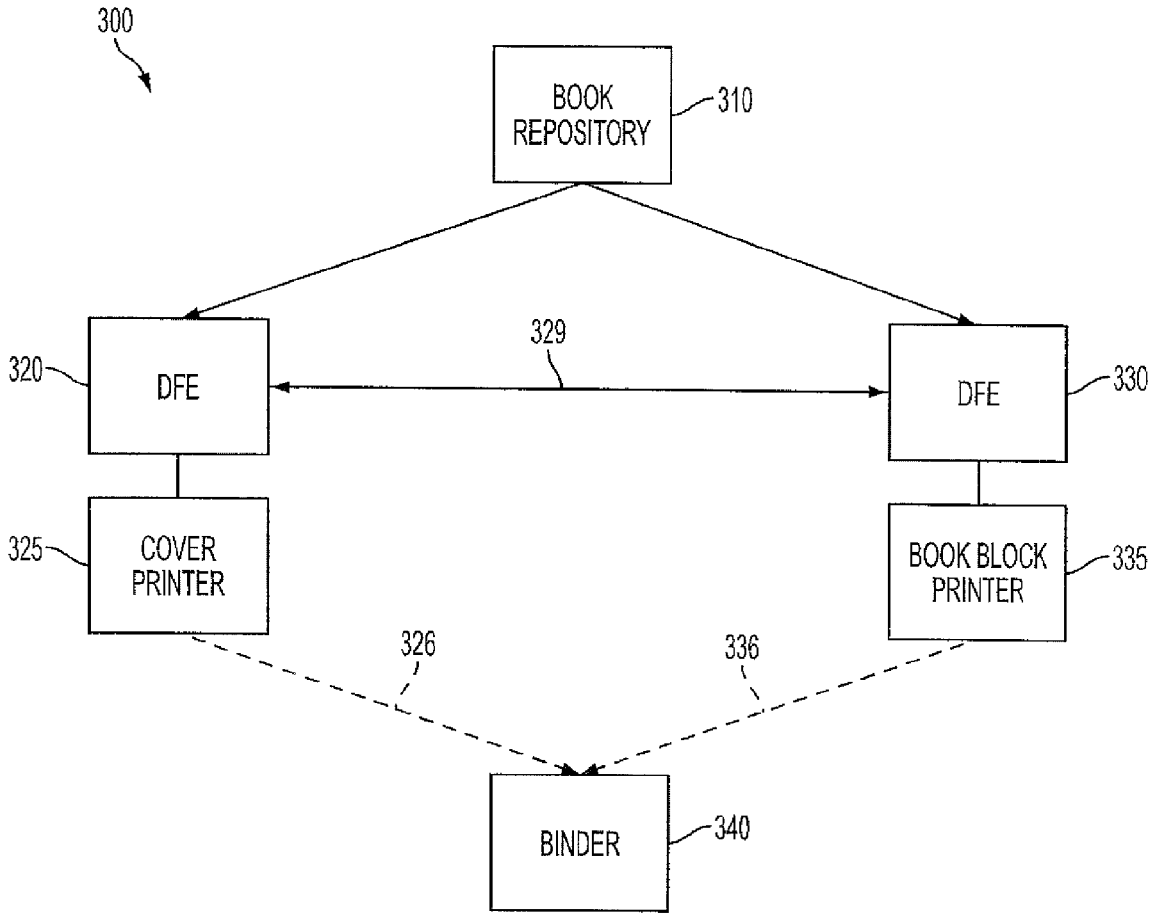
FIG. 3B depicts another exemplary architecture for a cover-driven book production system including a line of communications between two DFEs in accordance with embodiments of the present teachings.

In another embodiment shown in FIG. 3B, first DFE 320 and second DFE 330 can exchange information, represented by line 329, to determine, for example, which book block to retrieve from book repository 310 and the number of copies of the retrieved book block to be printed. In this embodiment, scanning is not performed since identification of the book block corresponding to the cover is determined by communication between first DFE 320 and second DFE 330. For example, based on a job ticket or input by a user, first DFE 320 can retrieve a cover file from book repository 310. After manipulating the cover file, first DFE 320 can provide data to cover printer 325 for printing a number of copies of the cover. At any time after retrieval of the cover file is initiated or at the same time retrieval of the cover file is initiated, second DFE 330 can communicate with first DFE 320 to determine which book block to retrieve from book repository 310. After retrieving the book block file corresponding to the cover file and manipulating the book block file, second DFE 330 can provide data to book block printer 335 for printing a number of copies of the book block. The covers and book blocks can be transported to off-line binder 340 for binding, as represented by dotted lines 326 and 336.

Figure 4A:
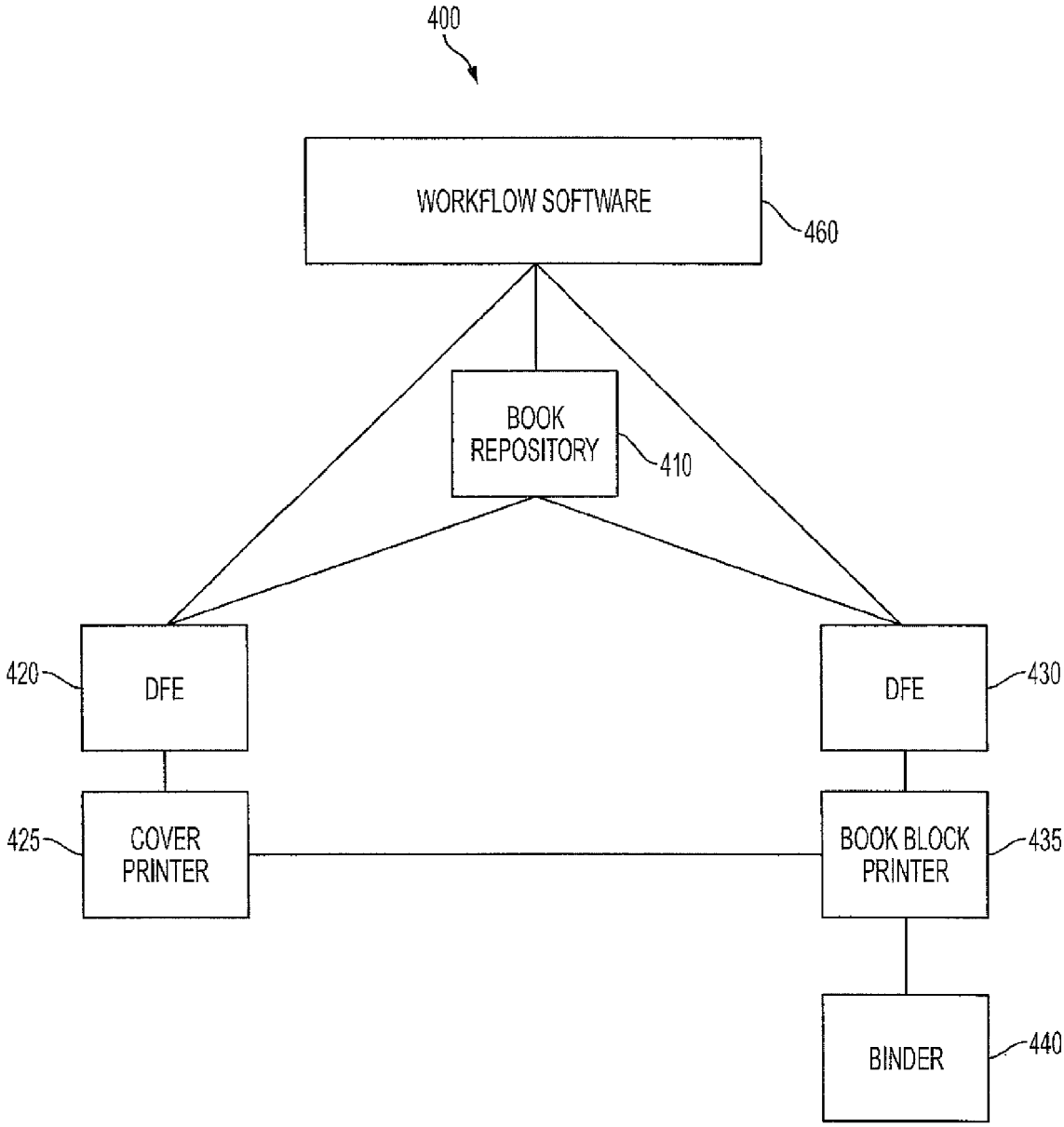
FIG. 4A depicts an exemplary architecture for a cover-driven book production system including workflow software in accordance with embodiments of the present teachings.

According to various embodiments, another exemplary architecture for a cover-driven system is provided in FIG. 4A. System 400 can include a book repository 410, a first DFE 420, a cover printer 425, a second DFE 430, a book block printer 435, and an in-line binder 440. System 400 can further include workflow software 460. Workflow software can be, for example, FreeFlow Book Manufacturing Workflow software by Xerox Corporation. Workflow software 460 can, for example, coordinate administrative tasks and production resources for many aspects of book production including prepress, RIPing and printing, and finishing. In operation, exemplary architecture for in-line cover-driven system 400 can function as follows. Based on a job ticket or input by a user, workflow software can initiate sending of a cover file to first DFE 420 from book repository 410. After manipulating the cover file, first DFE 420 can provide data to cover printer 425 for printing a number of copies of the cover. Because cover files, such as, for example, color cover files, can require extensive RIPing and printing time, workflow software 460 can coordinate printing of the corresponding book block to increase efficiency. For example, workflow software 460 can initiate sending the corresponding book block file to second DFE 430 once printing of the covers has neared completion. Copies of the covers can then be transported to the bypass tray of book block printer 435. A scanner integrated in or near the bypass tray can then examine and identify the covers. Once the printed covers have been identified as corresponding to the printed book blocks, the printed covers and printed book blocks can be transported to the in-line binder for binding.

Figure 4B:
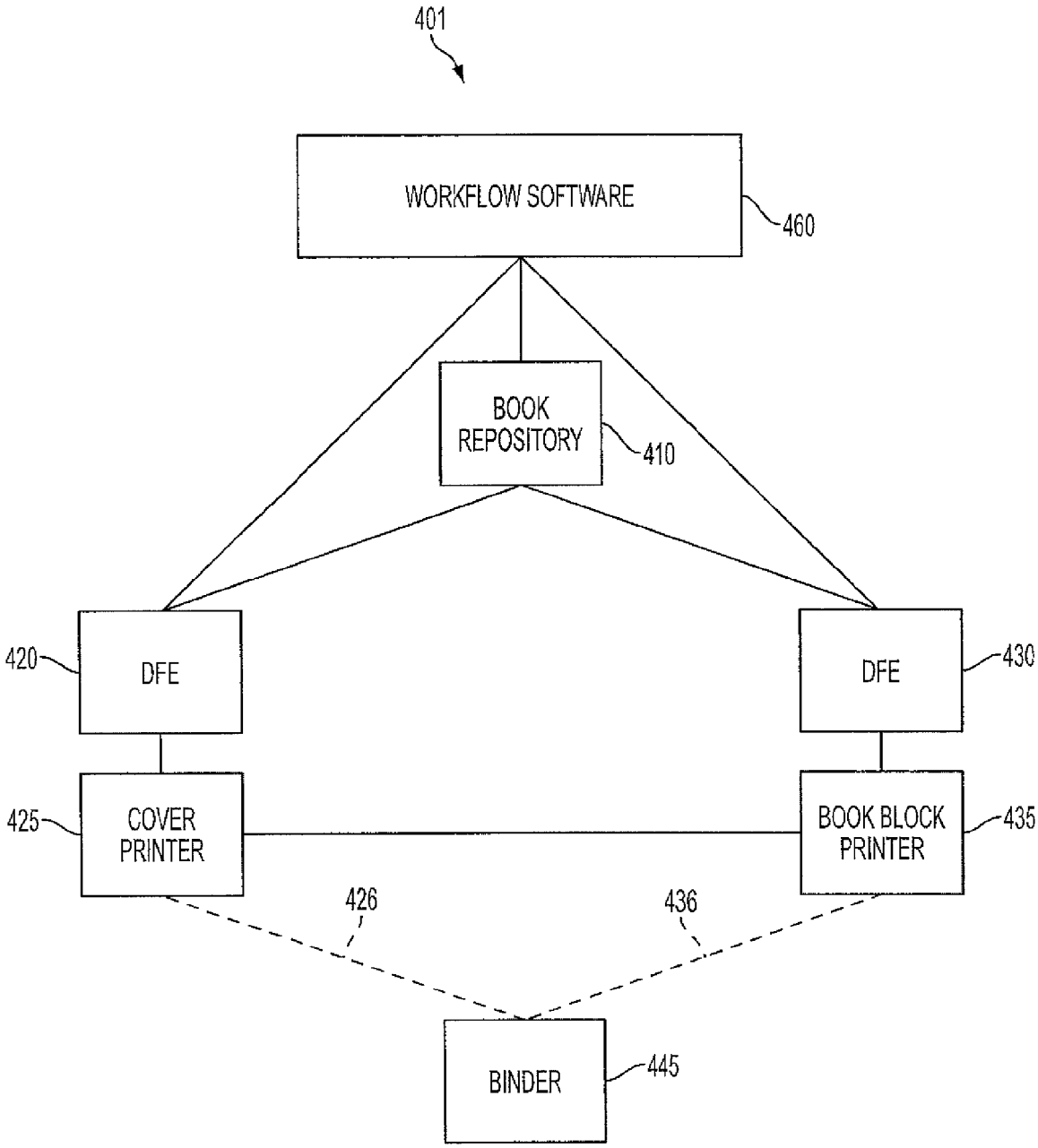
FIG. 4B depicts another exemplary architecture for a cover-driven book production system including workflow software in accordance with embodiments of the present teachings.

Another exemplary architecture for a cover-driven system is provided in FIG. 4B. System 401 is similar to system 400 shown in FIG. 4A, except that the binder is off-line. System 401 can include a book repository 410, a first DFE 420, a cover printer 425, a second DFE 430, a book block printer 435, and an off-line binder 445. System 401 can further include workflow software 460. Workflow software can be, for example, FreeFlow Book Manufacturing Workflow software by Xerox Corporation. In operation, exemplary architecture for off-line cover-driven system 401 can function as follows. Based on a job ticket or input by a user, workflow software can initiate sending of a cover file to first DFE 420 from book repository 410. After manipulating the cover file, first DFE 420 can provide data to cover printer 425 for printing a number of copies of the cover. Because cover files, such as, for example, color cover files, can require extensive RIPing and printing time, workflow software 460 can coordinate printing of the corresponding book block to increase efficiency. For example, workflow software 460 can initiate sending the corresponding book block file to second DFE 430 once printing of the covers has neared completion. The book block file can be manipulated by second DFE430 and then printed by book block printer 435. The printed covers and book blocks can then be transported to the off-line binder 445 for binding, as represented by dotted lines 426 and 436.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A book production system comprising:

a book repository;

a first digital front end (DFE) that drives a cover printer, wherein the first DFE receives a cover data file from the book repository for printing of a cover; and a second DFE that drives a book block printer and comprises a scanner to identify the printed cover, wherein the second DFE retrieves a book block data file from the book repository corresponding to the identified printed cover for printing of a book block.

2. The book production system of claim 1, further comprising a line of communication between the first DFE and the second DFE to exchange information on retrieving the book block data file corresponding to the identified printed cover.

3. The book production system of claim 1, further comprising a binder disposed in-line with the book block printer, the in-line binder configured to receive printed covers and printed book blocks transported from the book block printer.

4. The book production system of claim 1, further comprising a binder disposed off-line from the book block printer, the off-line binder comprising a tray for loading printed covers and a tray for loading printed book blocks.

5. The book production system of claim 1, wherein the book block printer comprises a bypass tray for accepting printed covers.

6. The book production system of claim 1, wherein the scanner identifies the cover by scanning one or more of barcodes, data glyphs, and images.

7. The book production system of claim 1, wherein the scanner is a hand-held scanner.

* * * * *